US005310995A

United States Patent [19]

Ouellet et al.

[11] Patent Number: 5,310,995

[45] Date of Patent: May 10, 1994

[54] STAIRWAY CALCULATOR

[75] Inventors: Nelson Ouellet; Robert Caouette, both of Mirabel, Canada

[73] Assignee: ZNR Concept, Inc., Mirabel, Canada

[21] Appl. No.: 935,879

[22] Filed: Aug. 26, 1992

[51] Int. Cl.[5] ..... G06G 1/02; B43L 7/10

[52] U.S. Cl. ..... 235/70 R; 235/70 A; 33/417

[58] Field of Search ..... 235/70 R, 70 A, 84, 235/70 C; 33/15 B, 15 D, 415, 417, 418, 419, 423, 494, 679.1; D18/9

[56] References Cited

U.S. PATENT DOCUMENTS

| | | | |
|---|---|---|---|
| 520,114 | 5/1894 | Johnson | 235/70 A |
| 1,431,409 | 10/1922 | Miller | 235/70 R |
| 3,863,348 | 2/1975 | Herbst | 33/494 |
| 3,933,305 | 1/1976 | Murphy | 235/70 |
| 4,001,551 | 1/1977 | Hirsimaki | 235/70 A |
| 4,103,809 | 8/1978 | Frost et al. | 224/5 |
| 4,124,796 | 11/1978 | Shores | 235/88 |
| 4,310,750 | 1/1982 | Kelley | 235/70 |
| 4,350,877 | 9/1982 | Yanagisawa et al. | 235/70 |
| 4,835,371 | 5/1989 | Rogers | 235/88 |

FOREIGN PATENT DOCUMENTS

| | | |
|---|---|---|
| 2244211 | 4/1975 | France . |
| 2384304 | 10/1978 | France . |

*Primary Examiner*—Michael L. Gellner

*Assistant Examiner*—Eddie C. Lee

*Attorney, Agent, or Firm*—Omri M. Behr; Matthew J. McDonald

[57] ABSTRACT

A slide rule comprises, to calculate the parameters of a stairway to be installed between lower and upper floor surfaces, (a) a first scale on a stationary body denoting the number of risers, (b) a second scale on a first slide denoting the elevation of the upper floor surface above the lower one and associated with a first arrow on the body, (c) a third scale on the body denoting tread depths and associated with a mark on the first slide, (d) a fourth scale on a second slide denoting the horizontal spread of the stairway and associated with a second arrow on the body, (e) a fifth scale on the body denoting the number of treads, and (f) a sixth scale on the second slide denoting the length of the stairwell and associated with a third arrow on the first slide. The first arrow indicates on the second scale the height of the risers when the number of risers on the first scale is aligned with the elevation of the upper floor surface on the second scale. The mark then indicates on the third scale a suggested range of tread depths. By indicating with the second arrow the depth of the treads on the fourth scale, the slide rule aligns the number of treads on the fifth scale with the horizontal spread of the stairway on the fourth scale. Finally, the third arrow indicates on the sixth scale the length of the stairwell.

16 Claims, 3 Drawing Sheets

STAIRWAY CALCULATOR

BACKGROUND OF THE INVENTION

The present invention relates to a device, of the slide rule type, capable of calculating the various parameters of a stairway to be installed between a lower floor surface and an upper floor surface.

In the past, slide rules for numerous purposes have been designed. For example, U.S. Pat. No. 4,310,750 granted to Kelly on Jan. 12, 1982, proposes a tactical nuclear slide rule for a plurality of environments, and U.S. Pat. No. 4,103,809 (Frost et al.) issued on Aug. 1, 1978, illustrates a slide rule to make calculations necessary for navigational purposes. French patent application published under No. 2,244,211 on Apr. 11, 1975 (Bousseau) describes another type of slide rule calculator.

The prior art therefore fails to propose a slide rule calculator capable of computing the height of the risers, the depth of the treads, the horizontal spread, the length of the stairwell, etc. of a stairway.

OBJECT OF THE INVENTION

An object of the present invention is therefore to provide a slide rule device capable of calculating stairway parameters.

SUMMARY OF THE INVENTION

In accordance with a first aspect of the present invention, there is provided a device for calculating the height of risers in a stairway to be installed between a lower floor surface, and an upper floor surface of given elevation above the lower floor surface, comprising:

first and second scale supports, one of these scale supports being mounted on the other of these first and second supports and being capable of sliding on said other support;

a first scale means on the first support, this first scale means comprising a plurality of indicia representative of numbers of risers;

a second scale means on the second support, the first and second scale means being laterally adjacent to each other and the second scale means comprising a plurality of elevation representative indicia; and indicia indicating means on the first support for indicating indicia of the second scale means.

In operation, when said one scale support is slid on the other support to align indicia of the first and second scale means corresponding to the number of risers in the stairway and the elevation of the upper floor surface above the lower floor surface, respectively, the indicia indicating means indicates on the second scale means the height of the risers.

According to another aspect of the subject invention, there is provided a device capable of calculating (a) the depth of treads in a stairway to be installed between lower and upper floor surfaces and having a given horizontal spread, and (b) for calculating the horizontal spread of a stairway having treads of given depth, comprising:

first and second scale supports, one of these first and second supports being mounted on the other scale support and being capable of sliding on this other support;

a first scale means on the first support, this first scale means comprising a plurality of indicia representative of numbers of treads;

a second scale means on the second support, the first and second scale means being laterally adjacent to each other and the second scale means comprising a plurality of horizontal spread representative indicia; and indicia indicating means on the first support for indicating indicia on the second scale means.

In operation, when said one scale support is slid on the other support to align indicia of the first and second scale means corresponding to the number of treads in the stairway and to the given horizontal spread of the stairway, respectively, the indicia indicating means indicates on the second scale means the depth of the treads. Also, when said one scale support is slid on the other support until the indicia indicating means indicates on the second scale means the given depth of the treads, indicia of the first and second scale means corresponding to the number of treads in the stairway and to the horizontal spread of the stairway, respectively, are aligned.

In accordance with a further aspect of the instant invention, there is provided a device capable of calculating (a) the height of risers in a stairway to be installed between a lower floor surface, and an upper floor surface of given elevation above the lower floor surface, (b) the depth of treads in a stairway having a given horizontal spread, and (c) the horizontal spread of a stairway comprising treads of given depth. This calculating device comprises:

a body comprising first and second scale support surfaces spaced apart from each other;

first and second slides mounted on the body between the first and second scale support surfaces and capable of sliding on this body, the first slide comprising a third scale support surface adjacent the first scale support surface, and the second slide comprising a fourth scale support surface interposed between the second and third scale support surfaces;

a first scale means on the first support surface, this first scale means comprising a plurality of indicia representative of numbers of risers;

a second scale means on the third support surface, the first and second scale means being laterally adjacent to each other and the second scale means comprising a plurality of elevation representative indicia;

first indicia indicating means on the body for indicating indicia on the second scale means;

a third scale means on the second support surface, this third scale means comprising a plurality of indicia representative of numbers of treads;

a fourth scale means on the fourth support surface, these third and fourth scale means being laterally adjacent to each other and said fourth scale means comprising a plurality of horizontal spread representative indicia; and second indicia indicating means on the body for indicating indicia on the fourth scale means.

In operation, when the first slide is slid on the body to align indicia of the first and second scale means corresponding to the number of risers in the stairway and to the elevation of the upper floor surface above the lower floor surface, respectively, the first indicia indicating means indicates on the second scale means the height of the risers. Also, when the second slide is slid on the body to align indicia of the third and fourth scale means corresponding to the number of treads in the stairway and to the given horizontal spread of the stairway, respectively, the second indicia indicating means indicates on the fourth scale means the depth of the treads. Moreover, when the second slide is slid on the body until the second indicia indicating means indicates on the fourth scale means the given depth of the treads, indicia of the third and fourth scale means corresponding to the number of treads in the stairway and to the horizontal spread of the stairway, respectively, are aligned.

In accordance with preferred embodiments, the first indicia indicating means corresponds to a number of one riser on the first scale means, the second indicia indicating means corresponds to a number of one tread on the third scale, and the first, second, third and fourth scale means are logarithmic scales.

In accordance with a further preferred embodiment, the calculating device comprises:

a fifth scale means on one of the first and third support surfaces, this fifth scale means comprising a plurality of tread depth representative indicia; and third indicia indicating means on the other of these first and third support surfaces for indicating a range of indicia on the fifth scale means.

When indicia of the first and second scale means corresponding to the number of risers of the stairway and to the elevation of the upper floor surface above the lower floor surface, respectively, are aligned, the third indicia indicating means indicates on the fifth scale means a suggested range of tread depths.

Again, the fifth scale means is a logarithmic scale.

In accordance with a further preferred embodiment, the calculating device comprises:

a sixth scale means on one of the third and fourth support surfaces, this sixth scale means comprising a plurality of stairwell length representative indicia; and fourth indicia indicating means on the other of these third and fourth support surfaces for indicating indicia on the sixth scale means.

When the first indicia indicating means indicates on said second scale means the height of the risers of the stairway and when the second indicia indicating means indicates on the fourth scale means the depth of the treads of the stairway, the fourth indicia indicating means indicates on the sixth scale means a required length for the stairwell of the stairway.

The sixth scale means is again a logarithmic scale.

According to a further aspect of the invention, there is provided a slide rule comprising an elongated hollow body on which first and second elongated slides are mounted, this body being formed with a longitudinal opening whereby it defines an open, longitudinal cavity in which the first and second elongated slides are disposed adjacent to each other.

In accordance with preferred embodiments, (a) the body of the slide rule includes first and second, substantially coplanar longitudinal wall portions separated by the longitudinal opening and defining respective first and second mutually facing edges, (b) the first slide is formed with shoulder means fitted onto the first edge and the second slide is also formed with shoulder means fitted onto the second edge, (c) the first wall portion includes a first scale supporting surface, the second wall portion includes a second scale supporting surface, the first slide includes a third scale supporting surface, and the second slide includes a fourth scale supporting surface, these first, second, third and fourth scale supporting surfaces being substantially coplanar, and (d) the hollow body defines a pair of mutually facing grooves in which said first and second slides are respectively mounted, the first groove having a bottom wall spaced apart from the first slide and the second groove having a bottom wall spaced apart from the second slide.

The objects, advantages and other features of the present invention will become more apparent upon reading of the following non restrictive description of a preferred embodiment thereof, given by way of example only with reference to the accompanying drawings.

DETAILED DESCRIPTION OF THE PREFERRED EMBODIMENT

Figure 1:
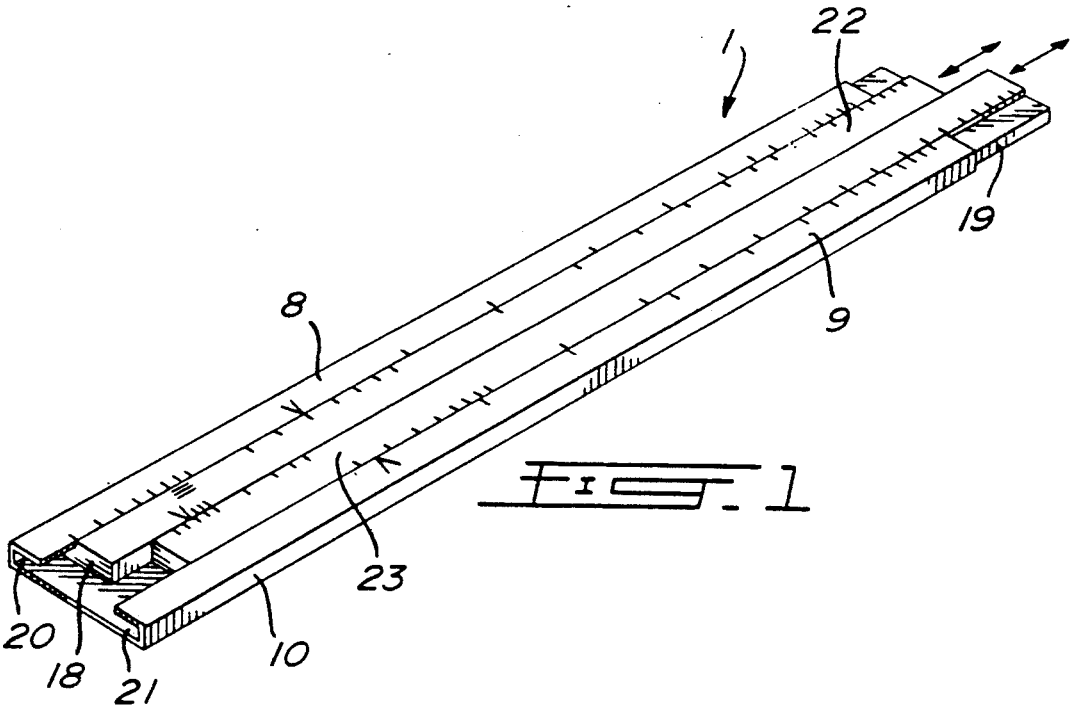
FIG. 1 is a perspective view of a slide rule stairway calculator in accordance with the present invention, comprising a body on which two slides are movably mounted.

As illustrated in FIG. 1, the slide rule stairway calculator, generally identified by the reference 1, is formed of two types of extrusions. Although other materials can be contemplated, these extrusions are preferably made of plastic material.

Figure 2:
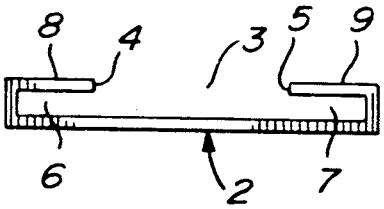
FIG. 2 is an end view of the body of the slide rule calculator of FIG. 1.

As illustrated, the stairway calculator comprises a hollow body 10 (FIG. 1) formed of an extrusion 2 (FIG. 2) having a rectangular, C-shaped cross section. As can be seen, the extrusion 2:

has a constant thickness;

comprises a longitudinal opening 3 delimited by the mutually facing longitudinal edges 4 and 5 of a pair of coplanar longitudinal walls, these two walls comprising longitudinal and coplanar outer surfaces 8 and 9 of constant width; and defines a pair of opposite longitudinal grooves 6 and 7.

To form the body 10 (FIG. 1) of the slide rule 1, a section of given length of the first extrusion 2 is cut.

Figure 3:
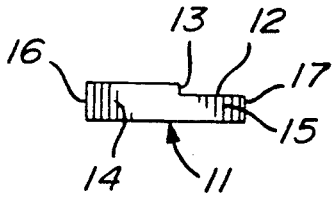
FIG. 3 is an end view of the slides of the slide rule calculator of FIG. 1.

The cross section of the second extrusion 11 is shown in FIG. 3. It is solid and formed with a depression 12 to form a shoulder 13. Accordingly, the extrusion 11 is formed of two laterally adjacent longitudinal portions, one 14 of larger thickness and the other 15 of smaller thickness. The extrusion 11 further comprises an edge 16 of larger width and an opposite edge 17 of smaller width.

To form the two slides 18 and 19 (FIG. 2) of the slide rule 1, two sections of the extrusion 11 are cut, these two sections having the same length as the body 10.

To assemble the slide rule 1, the portion 15 of smaller thickness of the slide 18 is inserted in the groove 6 of the body 10, with the shoulder 13 of the slide 18 abutting against the edge 4 of the body 10. In the same manner, the portion 15 of smaller thickness of the slide 19 is inserted in the groove 7 of the body 10, with the shoulder 13 of the slide 19 abutting against the edge 5 of the body 10. The edges 16 of larger thickness of the slides 18 and 19 then abuts against each other.

As shown in FIG. 1, the added widths of the portions 14 of larger thickness of the slides 18 and 19 corresponds to the spacing between the mutually facing edges 4 and 5 of the body 10.

Of course, the extrusions 2 and 11 are so dimensioned that the slides 18 and 19 fit in the body 10 with a small clearance to enable longitudinal sliding of these slides 18 and 19 in the body 10. To facilitate such sliding, the width of the longitudinal portion 15 of the extrusion 11 is selected to leave a space 20 between the edge 17 of the slide 18 and the bottom of the groove 6 of the body 10, and also to leave a space 21 between the edge of smaller width 17 of the slide 19 and the bottom of the groove 7 of the body 10.

The thickness of the longitudinal portions 14 of the slides 18 and 19 is selected to make the longitudinal surfaces 8 and 9 of the body 10 and the longitudinal top surfaces 22 and 23 of these portions 14 coplanar as illustrated in FIG. 1.

Figure 4:
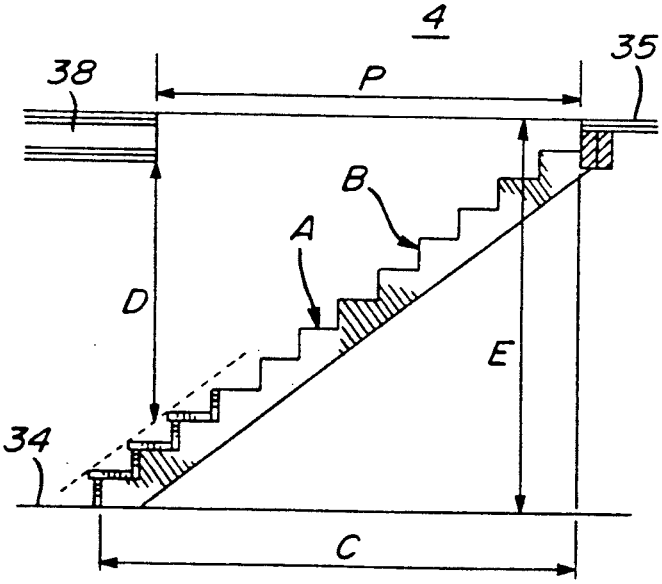
FIG. 4 represents schematically the various parameters of a stairway.

FIG. 4 illustrates the different parameters involved in calculating a stairway. These parameters includes the depth of the treads A, the height of the risers B, the horizontal spread C of the stairway, the headroom D, the elevation E of the upper floor surface 35 above the lower floor surface 34, the length of the stairwell P, and the thickness T of the upper floor 38.

Figure 5:
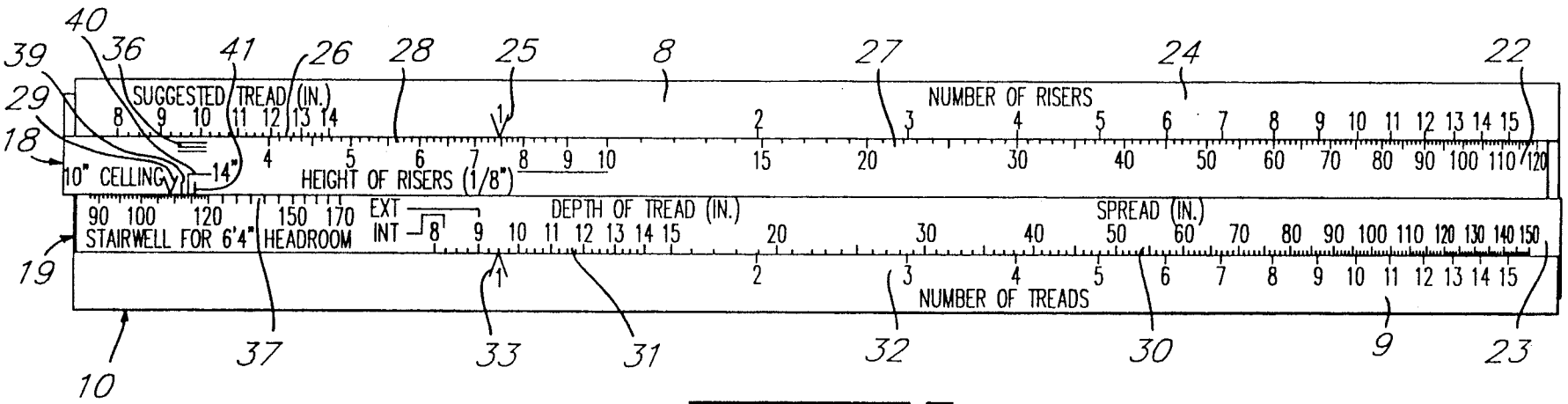
FIGS. 5, 6 and 7 are top plan views of the slide rule stairway calculator in accordance with the present invention, illustrating the different scales and showing examples of calculations that can be performed by this calculator.
Figure 6:
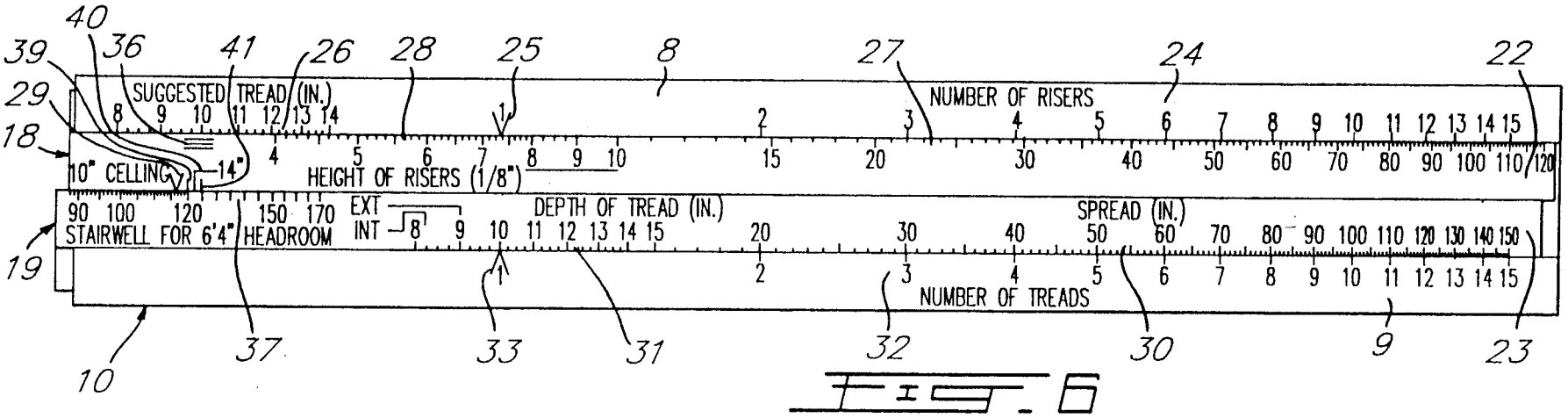
Figure 7:
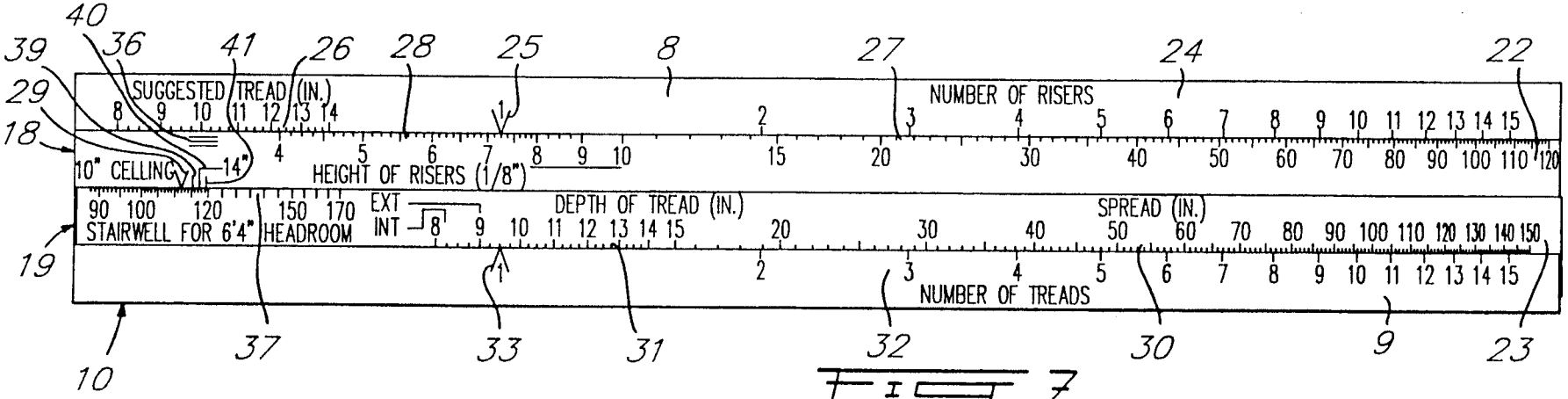

As shown in FIG. 5, the surface 8 is provided with (a) a logarithmic scale 24 adjacent the slide 18 and including indicia representative of the number of risers B of the stairway, (b) an arrow 25 pointing toward portion 28 of the scale of the scale 27 on the slide 18, this arrow 25 corresponding to a number of one riser on the scale 24, and (c) a logarithmic scale 26 adjacent the slide 18 and comprising indicia representative of tread depths.

The surface 22 of the slide 18 includes (a) a logarithmic scale 27, adjacent the longitudinal edge 4 of the body 10 and comprising indicia representative of the elevation E of the upper floor surface 25 (FIG. 4) above the lower floor surface 24, (b) a set of three longitudinal bars 36 of predetermined length adjacent the edge 4 of the body 10, and (c) an arrow 29 pointing toward the slide 19.

The surface 23 is provided with (a) a logarithmic scale 30 adjacent the longitudinal edge 5 of the body 10 and comprising indicia representative of the horizontal spread C of the stairway, and (b) a scale 37 comprising indicia representative of the length of the stairwell P, situated adjacent the slide 18.

Finally, the surface 9 of the body includes (a) a logarithmic scale 32 having indicia representative of the number of treads A, and (b) an arrow 33 pointing toward portion 31 of the scale 30 on the slide 19, the arrow 33 corresponding to a number of one tread on scale 32.

Operation of the slide rule stairway calculator 1 in accordance with the present invention will now be described.

EXAMPLE #1 (FIG. 5)

The parameters of an outside stairway without space limitation are calculated.

The elevation between the top surface of a balcony and the ground is measured. This elevation is E=30 inches. The slide 18 is then moved longitudinally to align the number 30 of scale 27 with the nearest whole number of scale 24, which is the number 4 (see FIG. 5). The height of the risers B is then indicated by the arrow 25 on portion 28 of scale 27. In the example illustrated in FIG. 5, the riser height if 7½ inches. Moreover, the set of three bars 36 suggests a depth for the treads A situated between 9¼ and 10 inches.

Let's choose a tread depth of 9½ inches. By displacing the slide 19 longitudinally until the arrow 33 indicates on portion 31 of scale 30 a tread depth of 9½ inches, the scale 30 indicates a spread C equal to 28½ inches for a number of 3 treads (scale 32).

EXAMPLE #2 (FIG. 6)

This example is concerned with an interior stairway.

The elevation E of the finished upper floor surface 35 (FIG. 4) above the finished lower floor surface 34 is first measured. In this example we will consider that the measured elevation E is equal to 96 inches. As in the first example, we align the number 96 on scale 27 with the nearest whole number on scale 24, which number is 13. The selected number of risers B is therefore 13. The arrow 25 then indicates on portion 28 of scale 27 a height of 7⅜ inches for the risers B. We then choose a number of 13 risers B 7⅜ inches high for a total elevation E of 96 inches.

The set of three bars 36 suggests a depth for the treads A situated between 9½ and 10¼ inches (see scale 26). Let's select a depth of 10 inches for the treads A.

The slide 19 is then moved longitudinally until the arrow 33 indicates the number 10 on portion 31 of the scale 30. We then obtain a number of 12 treads A for a spread C of 120 inches (see scales 32 and 30, respectively).

In order to determine the length of the stairwell P, the user has only to read the measure given by the arrow 29 on the scale 37. The reading is 117 inches. The length of 117 inches for the stairwell P will give the required 6 feet 4 inches for headroom D.

The reading given by the arrow 29 on the scale 37 is suitable for an upper floor 38 (FIG. 4) of which the thickness T is 10 inches. For floors 3B 12, 14 and 16 inches thick, lines 39, 40 and 41, respectively, on the surface 22 of the slide 18 are used to read the length of the stairwell P on scale 37.

EXAMPLE #3 (FIG. 7)

When the length of the spread is limited to a given value, for example 48 inches for the upper flight of a quarter turn stairway, the depth of the treads A is determined as follows. If 5 treads A are required, the slide 19 is moved longitudinally until the number 48 of scale 30 is aligned with the number 5 of scale 32. The arrow 33 then indicates on scale 31 a depth of 9⅝ inches for the treads A.

As can be appreciated by one skilled in the art, the height of the risers B of a quarter turn stairway are determined as described above in example 2.

Although the present invention has been described hereinabove by way of a preferred embodiment thereof, this embodiment can be modified at will, within the scope of the appended claims, without departing from the spirit and nature of the present invention.

What is claimed is:

1. A device for calculating the height of risers in a stairway to be installed between a lower floor surface, and an upper floor surface of given elevation above said lower floor surface, comprising:

first and second scale support surfaces adapted to slide with respect to each other;

a first scale means on said first support surface, said first scale means comprising a plurality of indicia representative of numbers of risers;

a second scale means on said second support surface, said first and second scale means being laterally adjacent to each other and said second scale means comprising a plurality of elevation representative indicia; and indicia indicating means on said first support surface for indicating indicia of the second scale means;

whereby, in operation, when said first and second scale support surfaces are slid with respect to each other to align indicia of the first and second scale means corresponding to the number of risers in said stairway and the elevation of the upper floor surface above the lower floor surface, respectively, said indicia indicating means indicates on the second scale means the height of said risers.

2. The calculating device of claim 1, wherein said indicia indicating means corresponds to a number of one riser on said first scale means.

3. The calculating device of claim 1, in which said first and second scale means are first and second logarithmic scales, respectively.

4. The calculatig device of claim 1, wherein said stairway comprises a plurality of treads of given depth, and wherein said calculating device further comprises:

a third scale means on one of said first and second support surfaces, said third scale means comprising a plurality of tread depth representative indicia; and second indicia indicating means on the other of said first and second scale support surfaces for indicating on said third scale means a range of indicia;

wherein, when indicia of the first and second scale means corresponding to the number of risers of said stairway and to the elevation of the upper floor surface above the lower floor surface, respectively, are aligned, said second indicia indicating means indicates on the third scale means a suggested range of tread depths.

5. The calculating device of claim 4 in which said third scale means is a logarithmic scale.

6. A device capable of calculating (a) the depth of treads in a stairway to be installed between lower and upper floor surfaces and having a given horizontal spread, and (b) the horizontal spread of a stairway comprising treads of given depth, comprising:

first and second scale support surfaces adapted to slide with respect to each other;

a first scale means on said first support surface, said first scale means comprising a plurality of indicia representative of numbers of treads;

a second scale means on said second support surface, said first and second scale means being laterally adjacent to each other and said second scale means comprising a plurality of horizontal spread representative indicia; and indicia indicating means on said first support surface for indicating indicia on the second scale means;

whereby, in operation, when said first and second scale support surfaces are slid with respect to each other to align indicia of the first and second scale means corresponding to the number of treads in the stairway and to said given horizontal spread of the stairway, respectively, said indicia indicating means indicates on the second scale means the depth of said treads; and whereby, in operation, when said first and second scale support surfaces are slid with respect to each other until said indicia indicating means indicates on said second scale means said given depth of the treads, indicia of the first and second scale means corresponding to the number of treads in the stairway and to the horizontal spread of the stairway, respectively, are aligned.

7. The calculating device of claim 6, wherein said indicia indicating means corresponds to a number of one tread on said first scale means.

8. The calculating device of claim 6, in which said first and second scale means are first and second logarithmic scales, respectively.

9. A device capable of calculating (a) the height of risers in a stairway to be installed between a lower floor surface, and an upper floor surface of given elevation above said lower floor surface, (b) the depth of treads in a stairway having a given horizontal spread, and (c) the horizontal spread of a stairway comprising treads of given depth, comprising:

a body comprising first and second scale support surfaces spaced apart from each other;

first and second slides mounted on said body between said first and second scale support surfaces and capable of sliding on said body, said first slide comprising a third scale support surface adjacent said first scale support surface, and said second slide comprising a fourth scale support surface interposed between said second and third scale support surfaces;

a first scale means on said first support surface, said first scale means comprising a plurality of indicia representative of numbers of risers;

a second scale means on said third support surface, said first and second scale means being laterally adjacent to each other and said second scale means comprising a plurality of elevation representative indicia;

first indicia indicating means on said body for indicating indicia on the second scale means;

a third scale means on said second support surface, said third scale means comprising a plurality of indicia representative of numbers of treads;

a fourth scale means on said fourth support surface, said third and fourth scale means being laterally adjacent to each other and said fourth scale means comprising a plurality of horizontal spread representative indicia; and second indicia indicating means on said body for indicating indicia on the fourth scale means;

whereby, in operation, when said first slide is slid on said body to align indicia of the first and second scale means corresponding to the number of risers in the stairway and to the elevation of the upper floor surface above the lower floor surface, respectively, said first indicia indicating means indicates on the second scale means the height of said risers;

whereby, in operation, when said second slide is slid on said body to align indicia of the third and fourth scale means corresponding to the number of treads in the stairway and to said given horizontal spread of the stairway, respectively, said second indicia indicating means indicates on the fourth scale means the depth of said treads; and whereby, in operation, when said second slide is slid on said body until said second indicia indicating means indicates on said fourth scale means said given depth of the treads, indicia of said third and fourth scale means corresponding to the number of treads in the stairway and to the horizontal spread of the stairway, respectively, are aligned.

10. The calculating device of claim 9, wherein said first indicia indicating means corresponds to a number of one riser on said first scale means, and said second indicia indicating means corresponds to a number of one tread on said third scale means.

11. The calculating device of claim 9, in which said first, second, third and fourth scale means are first, second, third and fourth logarithmic scales, respectively.

12. The calculating device of claim 9, further comprising:

a fifth scale means on one of said first and third support surfaces, said fifth scale means comprising a plurality of tread depth representative indicia;

third indicia indicating means on the other of said first and third support surfaces for indicating a range of indicia on said fifth scale means;

wherein, when indicia of the first and second scale means corresponding to the number of risers of the stairway and to the elevation of the upper floor surface above the lower floor surface, respectively, are aligned, said third indicia indicating means indicates on the fifth scale means a suggested range of tread depths.

13. The calculating device of claim 12, in which said fifth scale means is a logarithmic scale.

14. The calculating device of claim 9, wherein the stairway comprises a stairwell having a length, and wherein said calculating device further comprises:

a fifth scale means on one of said third and fourth support surfaces, said fifth scale means comprising a plurality of stairwell length representative indicia;

third indicia indicating means on the other of said third and fourth support surfaces for indicating indicia on the fifth scale means;

wherein, when said first indicia indicating means indicates on said second scale means the height of the risers of the stairway and when said second indicia indicating means indicates on said fourth scale means the depth of the treads of the stairway, the third indicia indicating means indicates on said fifth scale means a required length for the stairwell.

15. The calculating device of claim 14, in which said fifth scale means is a logarithmic scale.

16. The calculating device of claim 14, wherein said upper floor surface is the top surface of an upper floor, and wherein said third indicia indicating means comprises a plurality of indicia indicating means each corresponding to a given thickness of said upper floor.

* * * * *